US006688408B2

(12) United States Patent
Barbera et al.

(10) Patent No.: US 6,688,408 B2
(45) Date of Patent: Feb. 10, 2004

(54) AUGER DRILL DIRECTIONAL CONTROL SYSTEM

(76) Inventors: James S. Barbera, 1635 37th St., Canton, OH (US) 44709; Russell J. Miller, 478 Parkview St., Golden, CO (US) 80401

( * ) Notice: Subject to any disclaimer, the term of this patent is extended or adjusted under 35 U.S.C. 154(b) by 0 days.

(21) Appl. No.: 09/855,363

(22) Filed: May 15, 2001

(65) Prior Publication Data

US 2002/0020559 A1 Feb. 21, 2002

Related U.S. Application Data

(60) Provisional application No. 60/204,715, filed on May 16, 2000.

(51) Int. Cl.[7] ..... E21B 7/08

(52) U.S. Cl. ..... 175/45; 175/61; 340/853.4; 340/853.6

(58) Field of Search ..... 175/45, 61; 299/1.8; 340/853.2–853.6; 324/326, 207.17, 346

(56) References Cited

U.S. PATENT DOCUMENTS

| | | | | |
|---|---|---|---|---|
| 3,767,836 A | | 10/1973 | Geis et al. | |
| 4,403,664 A | | 9/1983 | Sullinger | |
| 4,646,277 A | | 2/1987 | Bridges et al. | |
| 4,854,397 A | | 8/1989 | Warren et al. | |
| 4,881,083 A | | 11/1989 | Chau et al. | |
| 5,099,927 A | * | 3/1992 | Gibson et al. | 175/45 |
| 5,203,418 A | * | 4/1993 | Gibson et al. | 175/45 |
| 5,361,854 A | | 11/1994 | Tull et al. | |
| 5,410,303 A | | 4/1995 | Comeau et al. | |
| 5,469,155 A | | 11/1995 | Archameault et al. | |
| 5,483,987 A | | 1/1996 | Amaudric du Chaffaut et al. | |
| 5,513,710 A | | 5/1996 | Kuckes | |
| 5,711,381 A | | 1/1998 | Archambeault et al. | |
| 6,079,506 A | * | 6/2000 | Mercer | 175/45 |
| 6,160,401 A | * | 12/2000 | Mercer | 324/326 |

* cited by examiner

*Primary Examiner*—Heather Shackelford
*Assistant Examiner*—Sunil Singh
(74) *Attorney, Agent, or Firm*—Sand & Sebolt

(57) ABSTRACT

An auger drill directional control system includes a positional transmitter mounted on a drillhead at the front of a pipe, the positional transmitter transmitting directional and pitch signals to a positional receiver disposed above the grade at the desired terminal location of the drillhead; the positional receiver transfers the signal information to the positional processor that detects deviations by the drillhead from the desired course of travel and produces a correction signal to compensate for the deviation; the correction signal is transmitted by a control transmitter and is received by a control receiver disposed on the underground boring machine; the control receiver passes the correction signal to the control processor which converts the correction signal into a correction command that is delivered to an adjustment apparatus operatively connected with the drillhead. The control system thus provides a closed loop control system that controls the drillhead in the vertical and horizontal directions with respect to the pipe and that employs a receiver that can be placed on the ground above grade and can be moved from position to position to allow the drillhead to be directed around obstacles.

10 Claims, 6 Drawing Sheets

AUGER DRILL DIRECTIONAL CONTROL SYSTEM

BACKGROUND OF THE INVENTION

1. Technical Field

The invention relates generally to underground boring machines and, more particularly, to a control system for controlling the path of a drillhead of an underground-boring machine. Specifically, the invention relates to a control system that controls the horizontal and vertical direction of a drillhead of an Ago underground boring machine as the drillhead is advanced in a translational direction through a subterranean location.

2. Background Information

Underground boring machines are typically employed to install subterranean piping without the need for excavation, as well as for other purposes. When installing subterranean piping, the underground boring machine typically includes a sled which is driven along a track. The sled carries a pipe and includes a translation mechanism that engages the track and drives the sled forward. The sled also includes a rotation mechanism that operates a drillhead in front of the pipe. A rotating auger is typically disposed within the pipe, with the rotating auger drawing soil and rock away from the drillhead for discharge outside of the subterranean location. The pipe is incrementally driven in the translational direction until it is installed through the desired subterranean location.

As is generally known and understood in the relevant art, the pipe that is driven by the underground boring machine is made up of a plurality of shorter sections of pipe of a given length. During the drilling operation for a given section of pipe, the sled travels along the track in the translational direction, thus driving the pipe into the subterranean location. Once the sled has reached the end of the track, the pipe is detached from the sled and the sled is returned to its starting point at the opposite end of the track. A new section of pipe is then welded to the previous section of pipe and the sled is restarted. The sled thus incrementally drives each section of pipe until the collective length of pipe has been driven into the desired subterranean location.

In driving a subterranean pipe, it is desirable that the direction of the drillhead be controlled to ensure that the pipe that follows directly behind the drillhead is installed into the proper subterranean location. Without some level of control of the drillhead direction, the pipe could ultimately follow an uncertain path inasmuch as the varying densities of the soil and the presence of rocks can alter the direction of the drillhead in unpredictable ways. It is thus preferred to provide directional control over the drillhead.

It is also preferred that the specific subterranean location of the drillhead be determinable at various times in order to help provide meaningful control of the drillhead. Stated otherwise, the course of the drillhead can be properly corrected only after the precise location of the drillhead has been determined. Once the drillhead has been determined to be off the desired course, a course compensation can be provided in any of a variety of known ways to preferably return the drillhead to the desired course. Such course correction is not, however, without difficulty.

The course of the drillhead is preferably corrected on a frequent basis inasmuch as subterranean conditions can alter the course of the drillhead at virtually any time. Such monitoring often requires substantial concentration and effort by the operator, thus increasing labor costs. Once the drillhead has strayed off the desired course, the drillhead can be returned to the desired course only gradually inasmuch as the pipe typically has a limited capacity for bending. As is understood in the relevant art, the pipe follows the drillhead both through the deviation from the desired course and through the course correction, thus limiting the rate of course correction to correspond with the capacity of the pipe for bending as it follows through the subterranean course. It is preferred, therefore, that deviations by the drillhead from the desired course be immediately detected and corrected. Furthermore, it is desired that such deviations be corrected in the proper measure without the overcorrection that often results in the drillhead overshooting the desired path, thus requiring an additional correction to compensate for the improper excessive previous adjustment which resulted in the overcorrection.

In order to determine the location of the drillhead in the subterranean location, a positional transmitter or sonde is provided at the drillhead location, with the sonde often being installed inside the drillhead. The sonde produces a positional signal in the form of a generally dipole magnetic field that can be detected by a positional receiver.

Once the location of the drillhead has been determined, the direction of the drillhead can be altered in both the vertical and horizontal directions. Numerous methods exist for altering the direction of the drillhead, such as adjustment of control rods attached to the drillhead, adjustment of the cutting tools on the drillhead, as well as other methods. It is preferred, however, that the positional signal received by the positional receiver be used to directly control the direction of the drillhead without any corrective commands being required from an operator. It is desired that the receiver be selectively positionable above the grade at the desired terminus for the pipe. It is further desired that the receiver be movable from location to location to permit the pipe to be directed around obstacles and to permit the pipe to follow a desired course. It is also desired to provide a control system that controls both the horizontal and vertical direction of the drillhead as the pipe is driven in a translational direction below grade.

SUMMARY OF THE INVENTION

In view of the foregoing, an objective of the present invention is to provide a control system for an underground boring machine that controls the horizontal and vertical directions of the drillhead.

Another objective of the present invention is to provide a control system for a underground boring machine wherein the receiver is selectively positionable above the grade.

Another objective of the present invention is to provide a control system for a underground boring machine that provides feedback to automatically control the direction of the drillhead.

Another objective of the present invention is to provide a control system for a underground boring machine that automatically controls the horizontal and vertical direction of the drillhead without the need for drillhead adjustments to be made by an operator.

Another objective of the present invention is to provide a control system for a underground boring machine, the control system having a receiver that can be readily repositioned above grade to permit the desired path of the drillhead to be adjusted.

Another objective of the present invention is to provide a control system for a underground boring machine that can control the installation of a subterranean pipe around an obstacle.

These and other objectives and advantages are obtained by the improved control system for an auger drill directional control system of the present invention, the general nature of which may be stated as including a positional transmitter disposed at a drillhead, the positional transmitter being adapted to transmit a positional signal, a positional receiver disposed above the grade and selectively positioned above the desire terminal location of the drillhead, the positional receiver being adapted to receive the positional signal from the positional transmitter, control means for communicating with the positional receiver and creating a correction signal, and an adjustment apparatus in communication with the control means, the adjustment apparatus operationally connected to the drillhead, the adjustment apparatus adapted to adjust the direction of the drillhead in response to the correction signal.

Still other objectives and advantages are obtained by the improved method of the present invention, the general nature of which can be stated as including the steps of providing an underground boring machine, providing a positional transmitter mounted on at least a part of the underground boring machine, generating a positional signal with the positional transmitter, providing a positional receiver, placing the positional receiver above the grade at the desired terminus and in line with the direction of the drillhead, receiving the positional signal by the positional receiver, generating a correction command, and adjusting the underground boring machine in response to the correction command.

BRIEF DESCRIPTION OF THE DRAWINGS

The preferred embodiment of the invention, illustrative of the best mode in which applicant has contemplated applying the principles of invention, is set forth in the following description and is shown in the drawings and is particularly and distinctly pointed out and set forth in the appended claims.

Similar numerals refer to similar parts throughout the specification.

DESCRIPTION OF THE PREFERRED EMBODIMENT

Figure 1:
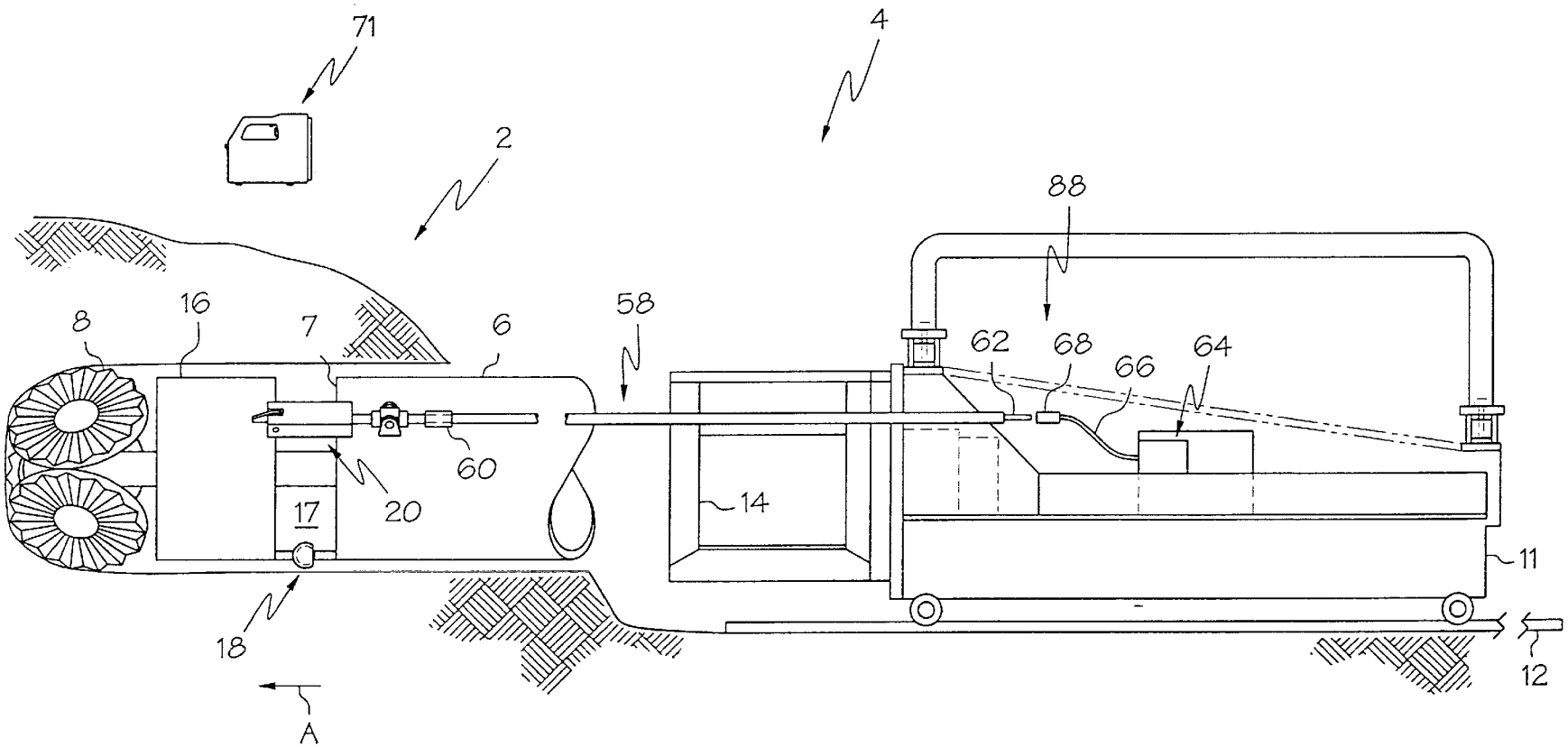
FIG. 1 is a side elevational view of a typical underground boring machine.

The control system of the present invention is indicated generally by the numeral 2 in FIG. 1. Control system 2 is used in conjunction with an underground boring machine 4 that drives a pipe 6 into a subterranean location. Underground boring machine 4 is any of a wide variety of underground boring machines known and understood in the relevant art.

Pipe 6 includes a leading end 7 that is driven into the subterranean location by underground boring machine 4. A drillhead 8 is operationally mounted on pipe 6 ahead of leading end 7. Underground boring machine 4 includes a sled 11 that carries pipe 6 and travels along a track 12 disposed against the ground. Sled 11 further includes an advancement mechanism that selectively engages holes formed in track 12 to advance sled 11 in a translational direction indicated generally by the arrow A in FIG. 1. As advancement mechanism 10 translates sled 11 along track 12 in the translational direction, a rotational mechanism simultaneously operates drillhead 8. The combined thrusting force of advancement mechanism 10 and the operation of drillhead 8 by the rotational mechanism drive drillhead 8 and pipe 6 into the subterranean location in the translational direction.

Inasmuch as pipe 6 travels directly behind drillhead 8 and occupies the hole as it is being drilled by drillhead 8, an auger 13 is provided to remove the soil and rock that has been cut away by drillhead 8 for discharge outside the subterranean location. Specifically, auger 13 is disposed within pipe 6 and pushes the loosened soil and rock away from the vicinity of drillhead 8 rearward in the direction of sled 11 for discharge through a discharge chute 14 at the side of sled 11. As is understood in the relevant art, drillhead 8 is operationally connected to the front of auger 13, with auger 13 being rotated by the rotational mechanism disposed on sled 11. As such, the rotation of auger 13 simultaneously drives drillhead 8 and removes the loosened soil and rock from the drilling location.

Figure 2:
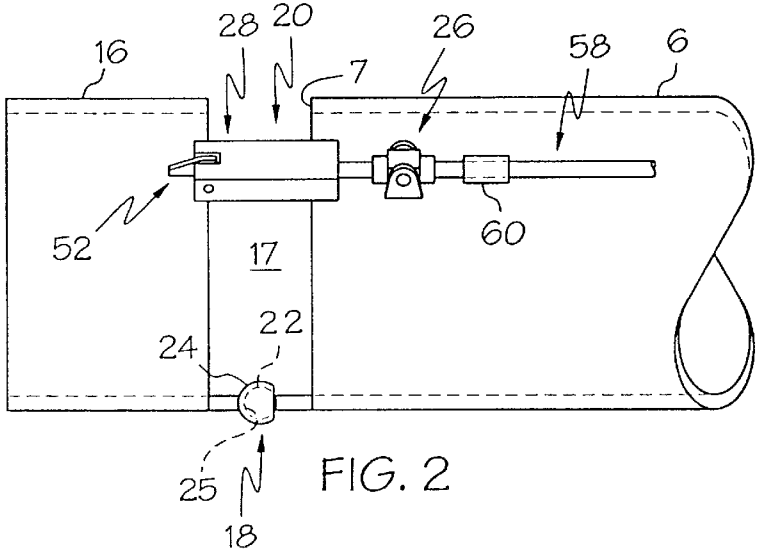
FIG. 2 is a side elevational view of the pipe showing the knuckle and one of the actuation drives.
Figure 4:
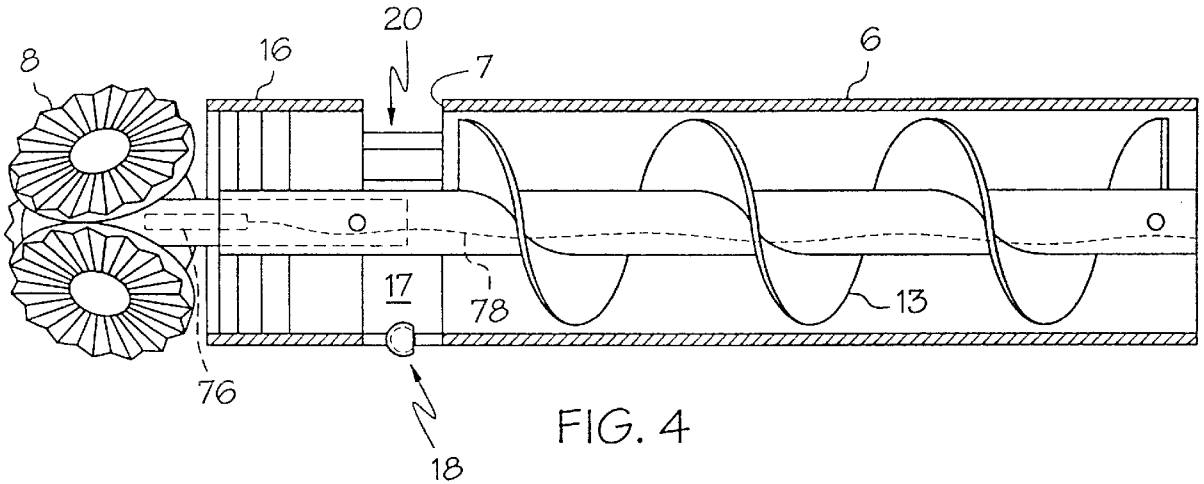
FIG. 4 is a side elevational view of the pipe of the present invention, partially cut away, showing the auger.

Drillhead 8 is typically mounted on a drillhead mount 16 which, in the preferred embodiment, is simply a short cutoff section of pipe 6. As is understood in the relevant art, drillhead 8 is selected to produce a hole at least nominally wider than the outer diameter of pipe 6. Drillhead 8 is mounted within drillhead mount 16 by known structures. Drillhead mount 16 is, in turn, mounted to pipe 6 adjacent leading end 7 by a knuckle 18 and a pair of actuation drives 20. As can be seen in FIGS. 1, 2 and 4, a gap 17 exists between leading end 7 and drillhead mount 16. Gap 17 permits drillhead mount 16 to be movable with respect to pipe 6 without interference therebetween. Knuckle 18 and actuation drives 20 traverse gap 17 to connect between leading end 7 and drillhead mount 16.

Figure 3:
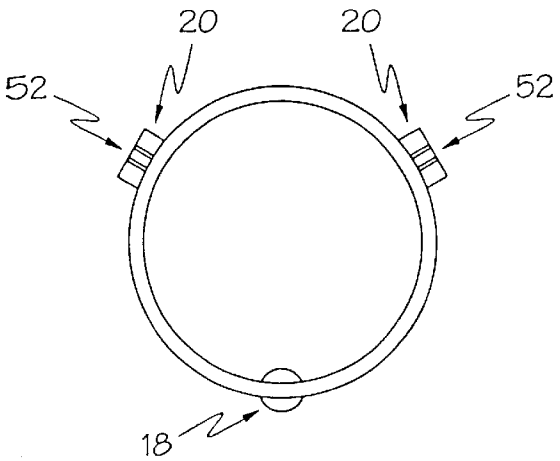
FIG. 3 is an end view of the pipe showing the knuckle and the actuation drives.

As is best shown in FIGS. 2 and 3, knuckle 18 extends between drillhead mount 16 and pipe 6 at the lowermost point along the circumference of pipe 6. The lowermost circumferential point of pipe 6 where knuckle 18 is mounted is defined as the six o'clock position, with the twelve o'clock position being diametrically opposed thereto at the uppermost circumferential point of pipe 6. The one o'clock through five o'clock positions and the seven o'clock through eleven o'clock positions are likewise defined at evenly distributed points along the circumference of pipe 6 between the twelve o'clock and six o'clock positions.

Actuation drives 20 each extend between pipe 6 and drillhead mount 16 (FIG. 2) and are preferably equally spaced along the circumference of pipe 6, both from knuckle 18 and from one another (FIG. 3). Actuation drives 20 are thus preferably disposed at approximately the two o'clock and ten o'clock positions, although it is understood that actuation drives 20 could be spaced at other positions along the circumference of pipe 6 without departing from the spirit of the present invention. Actuation drives 20 are most preferred to be equally spaced from knuckle 18 and from one another, thus being 120° apart from one another and from knuckle 18. Actuation drives 20 may, however, be disposed along the circumference of pipe 6 approximately 100° to 140° from knuckle 18 and spaced apart from one another approximately 80° to 160° without departing from the spirit of the present invention. It is likewise understood that virtually any positioning of actuation drives 20 and knuckle 18 may be appropriate in a given application.

Knuckle 18 includes a ball 22 mounted on pipe 6 adjacent leading end 7 and a socket 24 mounted on drillhead mount 16. Socket 24 is formed with a seat 25 that is sized and shaped to receive ball 22 therein. Ball 22 and seat 25 are both preferably spherically shaped in order to permit drillhead mount 16 to be adjustable in both the vertical and horizontal directions with respect to the length of pipe 6. More specifically, the vertical direction is defined as an axis that includes the six o'clock and twelve o'clock positions along the circumference of pipe 6 at leading end 7. Likewise, the horizontal direction is perpendicular to the vertical direction and is defined as an axis that includes the three o'clock and nine o'clock positions of pipe 6 at leading end 7. It is understood, therefore, that while the spherical configuration of ball 22 and seat 25 permits drillhead mount 16 to move in both the vertical and horizontal directions with respect to pipe 6, it is likewise understood that knuckle 18 may be of virtually any configuration so long as it permits drillhead mount 16 to move in both the vertical and horizontal directions with respect to pipe 6.

As is shown in FIGS. 1, 3, and 4, socket 24 is mounted on drillhead mount 16 and ball 22 is mounted on pipe 6 adjacent leading end 7. Such a configuration is preferred to minimize the amount of soil that is collected in socket 24 as pipe 6 is advanced in the translational direction. As is understood in the relevant art, soil that becomes trapped between socket 24 and ball 22 can cause abrasion therebetween, ultimately resulting in the failure of knuckle 18. It is understood, however, that knuckle 18 and the components thereof may be of substantially any configuration that permits drillhead mount 16 to move in both the vertical and horizontal directions with respect to pipe 6.

Figure 11:
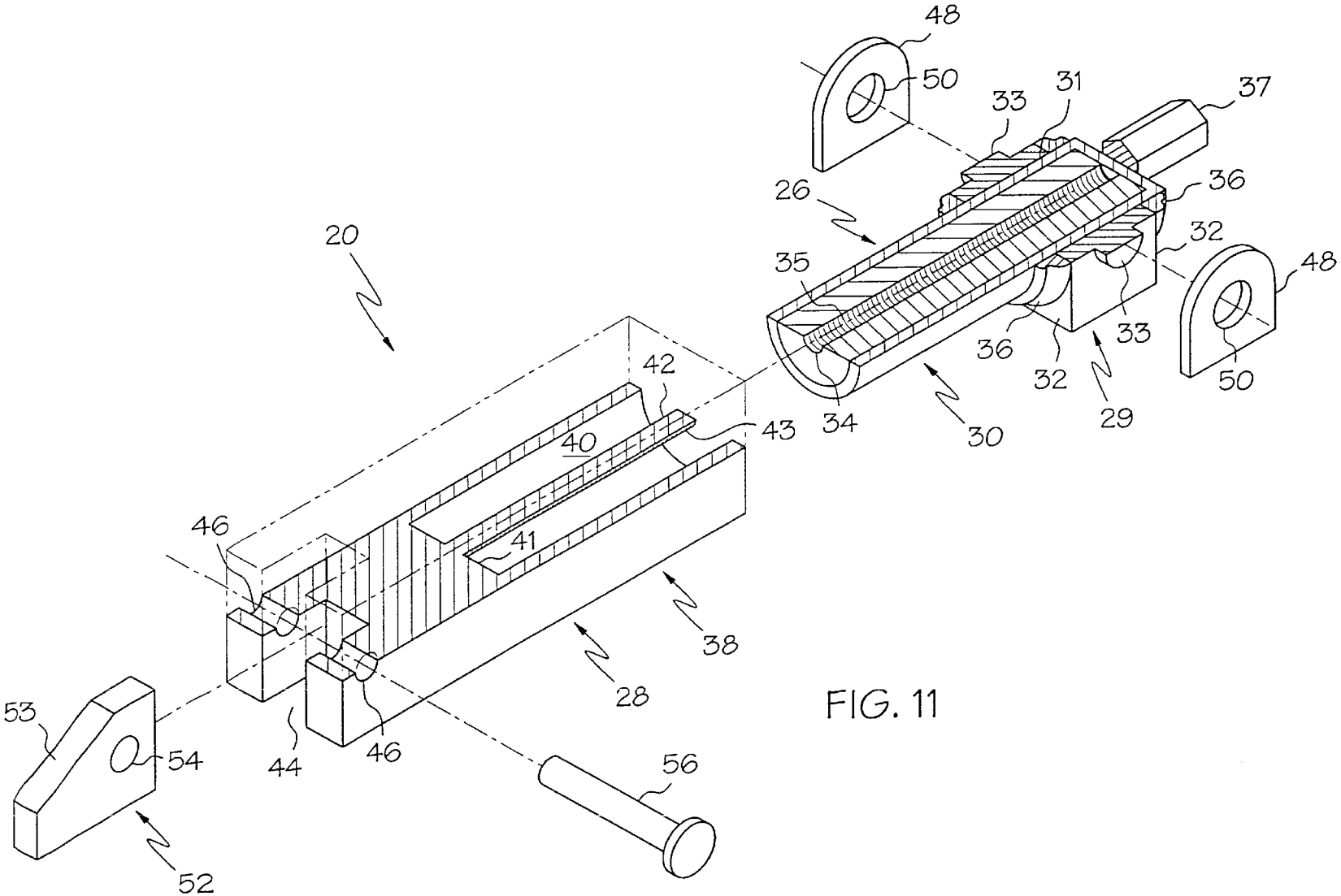
FIG. 11 is a perspective view, partially in section, of an actuation drive.
Figure 12:
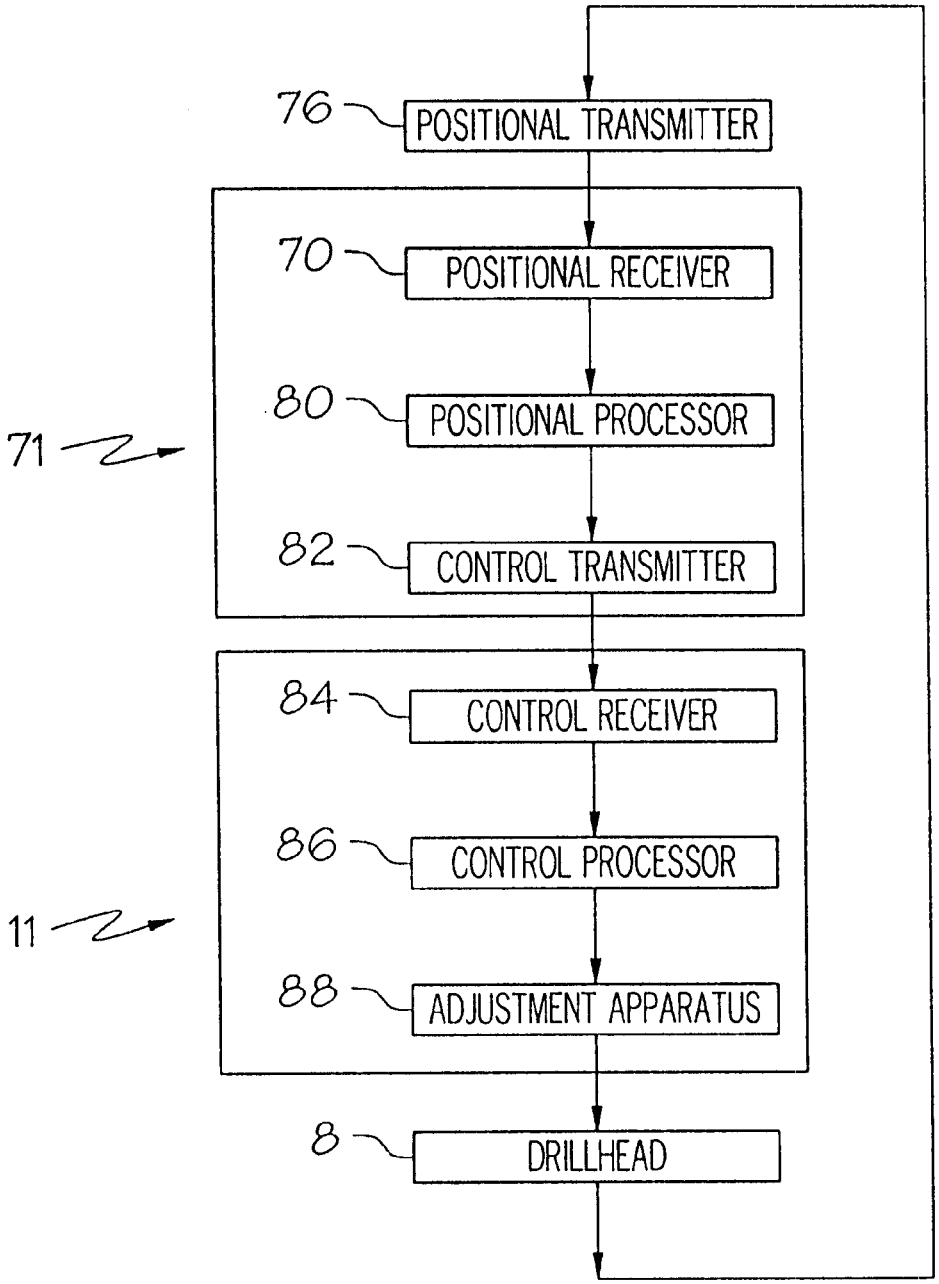
FIG. 12 is a flowchart of the control system of the present invention.

Actuation drives 20 each include a fixed member 26 mounted on pipe 6 and a movable member 28 mounted on drillhead mount 16. As is shown in FIG. 11, fixed member 26 includes an elongated hollow collar 29 and a threaded sleeve 30 extending therethrough. Collar 29 is formed with a substantially cylindrical through bore 31 and terminates at a pair of opposed substantially planar end surfaces 32. A pair of protrusions 33 extend outwardly from collar 29 in opposed directions approximately midway between end surfaces 32.

Threaded sleeve 30 is an elongated body formed with an axially disposed cylindrical central bore 34 at least partially therethrough. A plurality of internal threads 35 are formed on central bore 34. Threaded sleeve 30 has an outer diameter at least nominally smaller than the diameter of through bore 31 such that threaded sleeve 30 may rotate inside through bore 31. A pair of retention flanges 36 extend outwardly from the outer surface of threaded sleeve 30 such that collar 29 is interposed between retention flanges 36. Retention flanges 36 are preferably disposed closely adjacent end surfaces 32 to prevent translation of threaded sleeve 30 with respect to collar 29, yet permit sleeve 30 to be freely rotatable within through bore 31.

Threaded sleeve 30 terminates at a drive head 37 opposite central bore 34. Drive head 37 preferably is of a polygonal cross section, such as a hexagonal section, for reasons set forth more fully below.

A pair of retention plates 48 mount fixed member 26 to pipe 6. Each retention plate 48 is a substantially planar member formed with a retention hole 50 that is sized and shaped to receive protrusion 33 of collar 29 therein. Retention plates 48 are each fixedly attached to the outer surface of pipe 6 by welding or with the use of other appropriate fastening structures. It is preferred that protrusions 33 and retention holes 50 be of a substantially circular cross section to permit fixed member 26 to be at least nominally pivotal on retention plates 48.

Movable member 28 includes an elongated rectangular block 38 formed with a substantially cylindrical cavity 40 at least partially therethrough. Cavity 40 is a blind hole starting at one end of block 38 and terminating at a substantially circular and planar inner surface 41 internal to block 38. An axially disposed threaded stud 42 extends outwardly from inner surface 41 coaxially with cavity 40. Threaded stud 42 includes a plurality of external threads 43 that cooperate threadably with internal threads 35 of threaded sleeve 30. Cavity 40 is of a sufficient diameter to accommodate threaded sleeve 30 therein without interference. Block 38 is formed with a notch 44 opposite cavity 40 and includes a pair of coaxial pin holes 46 disposed on alternate sides of notch 44.

An actuation plate 52 retains movable member 28 on drillhead mount 16. Actuation plate 52 is a substantially planar member formed with an angled face 53 and a drive hole 54. Actuation plate 52 is welded or otherwise affixed to drillhead mount 16 such that angled face 53 faces toward drillhead 8. Actuation plate 52 is received in notch 44 of movable member 28 and a pin 56 is slidingly received in pinholes 46 and drive hole 54 and retained therein by known structures. The diameter of drive hole 54 is at least nominally greater than the outer diameter of pin 56 such that movable member 28 is at least partially pivotally mounted on drillhead mount 16 with actuation plate 52.

Threaded sleeve 30 is at least partially threaded onto threaded stud 42 of movable member 28 when actuation drive 20 is installed across pipe 6 and drillhead mount 16. It is most preferred that threaded sleeve 30 be threaded approximately halfway down the length of threaded stud 42 when drillhead mount 16 is oriented coaxially with pipe 6. As will be set forth more fully below, such threaded configuration permits threaded sleeve 30 to be threaded farther onto threaded stud 42 or on unthreaded therefrom to adjust the position of drillhead mount 16 in the vertical and horizontal directions with respect to pipe 6.

A drive rod 58 is attachable to drive head 37 of threaded sleeve 30 to threadably adjust the position of sleeve 30 with respect to threaded stud 42. Drive rod 58 is an elongated member terminating at a drive socket 60 and a drive head 62 at opposite ends thereof. Drive socket 60 is sized to receive drive head 37 of fixed member 26 therein. Drive head 37 is operatively received in drive socket 60 and retained therein by known structures. Drive head 62 is preferably configured to be substantially identical to drive head 37 of actuation drive 20 and receivable in drive socket 60 of another drive rod 58, thus permitting multiple drive rods 58 to be attached sequentially to one another depending upon the requirements of the application.

With drive head 37 received in drive socket 60 of drive rod 58, drive rod 58 is operatively connected with threaded sleeve 30 such that selective rotation of drive rod 58 results in threaded sleeve 30 being threaded onto or unthreaded from threaded stud 42 of movable member 28 as desired. As will be set forth more fully below, the action of threaded sleeve 30 in being threaded onto and unthreaded from threaded stud 42 of movable member 28 adjusts the direction of drillhead 8 with respect to pipe 6, and thus allows the direction of pipe 6 to be controlled as it advances in the translational direction. As such, it is preferred that drive head 37 and drive socket 60 share the same polygonal cross section such that drive head 37 can be quickly slidably received in drive socket 60 with minimal effort and such that rotational movements of drive rod 58 are mechanically transferred to drive head 37 with minimal backlash therebetween. As is understood in the relevant art, the complementary polygonal cross sections of drive head 37 and drive socket 60 causes drive head 37 and drive socket 60 to be frictionally held together during rotation, thus causing drive rod 58 and drive head 37 to rotate in unison. It is understood, however, that drive head 37 and drive socket 60 could be of virtually any cross section, polygonal or otherwise so long as the rotation of drive rod 58 is mechanically transferred to drive head 37 with minimal backlash therebetween.

It is preferred that knuckle 18, actuation drives 20, retention plates 48, actuation plate 52, pin 56, and drive rods 58 be manufactured of a tough, relatively rigid material such as steel, aluminum, titanium, or other appropriate material suited to withstand subterranean conditions. It is understood, however, that other materials may be employed depending upon the particular application without departing from the spirit of the present invention.

Drive head 62 of drive rod 58 is configured to be operatively connected with a control motor 64 disposed on sled 11. Two control motors 64 are disposed on sled 11, each of control motors 64 controlling the operation of one of actuation drives 20. Control motors 64 can be any of a variety of motors known and understood in the relevant art, but are preferably stepper motors. Control motors 64 each include a flexible coupling 66 having a drive socket 68 that operatively connects with drive head 62 of drive rod 58. Flexible coupling 66 is provided to obviate the need for control motor 64 to be mounted coaxially with drive rod 58, and additionally permits pipes of different diameters to be installed by underground boring machine 4 without requiring the position of control motors 64 to be readjusted. Moreover, the rotation of drive rod 58 by control motor 64 results in at least a nominal threaded translation of drive rod 58 in a direction parallel with the length of pipe 6, as will be set forth more fully below. Flexible coupling 66 thus further obviates the need for control motors 64 to be translatable in conjunction with drive rod 58.

Inasmuch as fixed member 26 and movable member 28 of actuation drives 20 are each securely mounted on pipe 6 and drillhead mount 16, respectively, it can be seen that the positive threading of threaded sleeve 30 on threaded stud 42 causes threaded sleeve 30 to be advanced into cavity 40, thus causing movable member 28 to be pulled relatively closer to fixed member 26. Likewise, the unthreading of threaded sleeve 30 from threaded stud 42 causes movable member 28 to be pushed farther away from fixed member 26. It can be seen, therefore, that the threading or unthreading of threaded sleeves 30 on threaded studs 42 results in movement of drillhead mount 16 with respect to pipe 6 in the vertical direction, the horizontal direction, or any combination of the two.

Inasmuch as socket 24 pivots about ball 22, the positive threading of both threaded sleeves 30 onto threaded studs 42 causes both movable members 28 to be pulled rearward toward fixed members 26, thus causing drillhead mount 16 to pivot on knuckle 18 in the upward vertical direction. Likewise, the unthreading of both threaded sleeves 30 results in movement by drillhead mount 16 in the downward vertical direction. The simultaneous threading of the threaded sleeve 30 at the two o'clock position and the unthreading of the threaded sleeve 30 at the ten o'clock position results in movement of drillhead mount 16 in the three o'clock direction. Movement of drillhead mount 16 in the nine o'clock direction is achieved by rotating threaded sleeves 30 in the reverse directions. As such, various combinations of threading and unthreading of threaded sleeves 30 on threaded studs 42 results in controllable movement of drillhead mount 16 in the horizontal and vertical direction with respect to pipe 6.

Control system 2 includes a mobile or moveable unit 71 that is preferably configured to be handheld. In addition to unit 71, system 2 inclues a positional transmitter 76, a control receiver 84, and a control processor 86. Unit 71 includes a positional receiver 70, a positional processor 80, and a control transmitter 82. The components of control system 2 cooperate to control the direction of drillhead 8 as pipe 6 is driven into the subterranean location. In accordance with the objectives of the present invention, control system 2 detects the position of drillhead 8, compares the position of drillhead 8 with the desired subterranean path that pipe 6 is intended to take, and provides corrective adjustments to return drillhead 8 to the desired path if it has departed therefrom.

Positional receiver 70 is any one of a variety of devices of the type known and understood in the relevant art having a first antenna 72 and a second antenna 74, with first and second antennas 72 and 74 being perpendicular to one another. For instance, positional receiver 70 may be a component of a data transceiver such as the Mark II transceiver sold under the name DIGITRAK™ by Digital Control Incorporated of Renton, Wash., U.S.A. The operation of the DIGITRAK™ Mark II transceiver is largely set forth in U.S. Pat. No. 5,155,442, the disclosures of which are incorporated herein by reference. It is understood, however, that positional receiver 70 may be a device other than the DIGITRAK™ Mark II transceiver without departing from the spirit of the present invention.

Likewise, positional transmitter 76 may be any of a variety of sensing and transmitting devices known and understood in, the relevant art that generate a substantially dipole magnetic field and transmit data regarding the pitch of positional transmitter 76 with respect to the horizontal direction. For example, positional transmitter 76 may be the 100' Cable Transmitter sold under the name DIGITRAK™ by Digital Control Incorporation of Renton, Wash., U.S.A. The 100' Cable Transmitter sold under the name DIGITRAK™ is largely described in U.S. Pat. No. 5,155,442. It is understood, however, that positional transmitter 76 may be virtually any one of a variety of devices known and understood in the relevant art that generates a substantially dipole magnetic field and transmits data regarding the pitch of positional transmitter 76 with regard to the horizontal direction.

Figure 7:
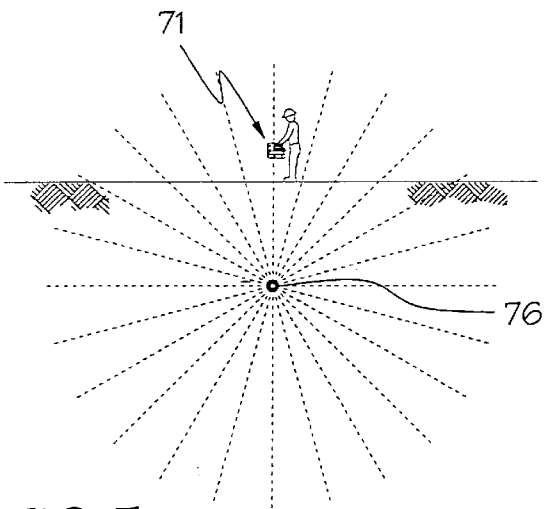
FIG. 7 is a diagrammatic end view of a workman locating the front and rear locate points.
Figure 6:
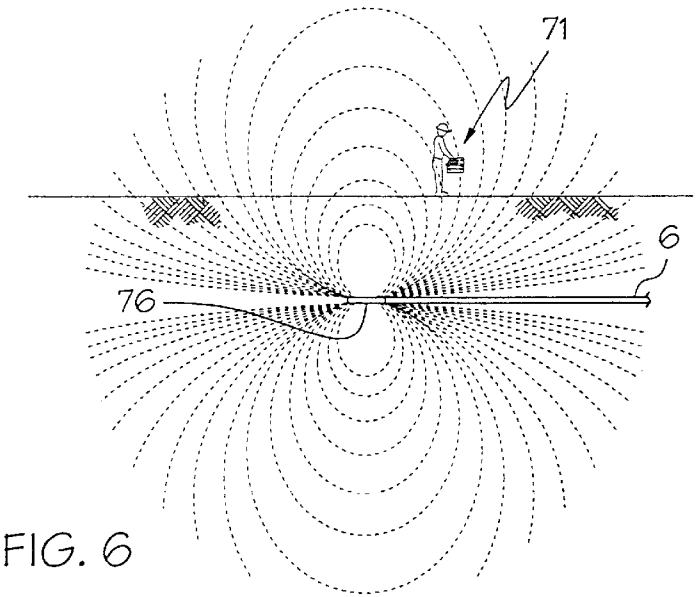
FIG. 6 is a diagrammatic side view of a workman locating the rear locate point.
Figure 9:
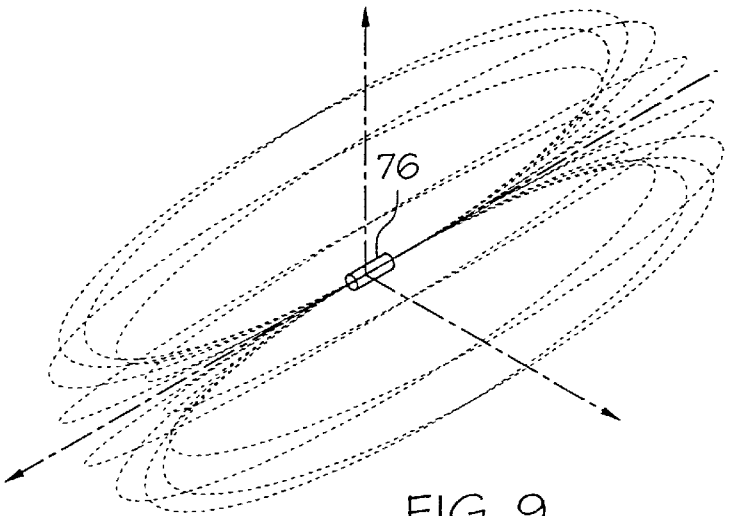
FIG. 9 is an isometric view of the generally dipole magnetic field generated by the sonde.
Figure 8:
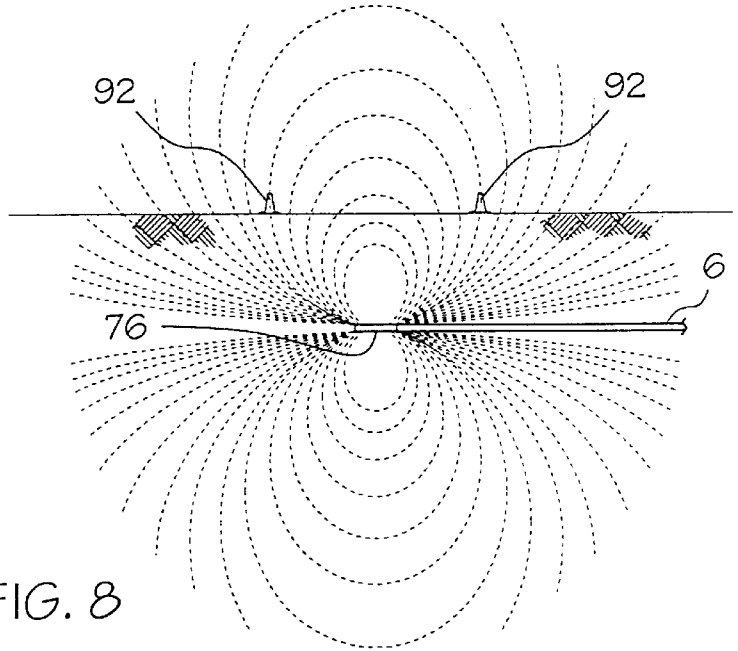
FIG. 8 is a diagrammatic side view showing the front and rear locate points marked with cones.

Positional transmitter 76 generates a substantially dipole magnetic field. A perspective view of the dipole magnetic field generated by positional transmitter 76 is depicted in FIG. 9. Likewise, a side view of the dipole magnetic field generated by positional transmitter 76 is depicted in FIGS. 6 and 8. Moreover, an end view of the dipole magnetic field generated by positional transmitter 76 is shown in FIG. 7. As will be set forth more fully below, positional receiver 70 is first used in conjunction with the dipole magnetic field generated by positional transmitter 76 to determine the depth, position, and direction of positional transmitter 76. Positional receiver 70 is then positioned at the surface of the grade in line with the direction of positional transmitter 76, and underground boring machine 4 is activated. As underground boring machine 4 drives pipe 6 into the subterranean location in the translational direction, positional transmitter 76 and positional receiver 70 cooperate with control motors 64 to control the direction of drillhead 8 and pipe 6 in the vertical and horizontal directions. The operation of control system 2 thus ensures that pipe 6 is driven through the desired subterranean location to a position directly below positional receiver 70.

As is understood in the relevant art, a linear antenna detects a magnetic field only when the field lines are parallel with the longitudinal axis of the antenna. A linear antenna thus produces a null when the magnetic field lines are perpendicular to the longitudinal axis of the antenna. It is understood, therefore, that when the field lines of the magnetic field are oblique to the longitudinal axis of the antenna, the antenna detects only the component of the field that is parallel therewith.

With particular reference to FIG. 6, it can be seen that a single horizontal antenna would register a null if held by a workman above grade at a point where the lines of the dipole magnetic field produced by positional transmitter 76 are perpendicular thereto. Such null positions occur behind positional transmitter 76 at a point above pipe 6, as well as ahead of positional transmitter 76, at a point above grade in front of positional transmitter 76 in the translational direction therefrom. These points are referred to as the front and rear locate points, respectively. The distance between the front and rear locate points is a function of the distance between the horizontal antenna and positional transmitter 76, i.e., a function of both the depth of positional transmitter 76 below grade and the height above grade where the horizontal antenna is held by the workman. The horizontal antenna registers the full strength of the field when it is held midway between the front and rear locate points, which is directly above positional transmitter 76.

While a horizontal antenna produces a peak signal between the front and rear locate points, the horizontal antenna correspondingly produces similar peaks or "ghost signals" as the antenna is moved from each locate point in a direction farther away from positional transmitter 76 inasmuch as the field lines beyond each locate point begin to have a component parallel with the horizontal antenna. Such ghost signals may interfere with the ability of the workman to determine which of the peaks constitutes the proper peak that is directly above positional transmitter 76.

The response of a single vertical antenna is similar to the response of the single horizontal antenna but is reversed. Specifically, the vertical antenna registers a null when disposed above positional transmitter 76 and registers the field at full strength at the points behind and ahead of positional transmitter 76 where the horizontal antenna registered nulls, i.e., the front and rear locate points. The single vertical antenna also suffers from the same ghost signals as the single horizontal antenna.

While the horizontal and vertical antennas can be combined to register a single signal strength with a peak occurring above positional transmitter 76, such an arrangement is still difficult to accurately use inasmuch as the precise position of the peak can be difficult to accurately ascertain, often resulting in positional determinations that may be a foot or more away from the true position of positional transmitter 76.

It is understood that the foregoing analysis is directed solely to movement of the antenna or antennas in a direction parallel with the length of pipe 6, as is indicated in FIG. 6. The determination of null points and peak points according to the foregoing analysis obtains equally whether the field measurements are taken directly over pipe 6 or are made parallel with the longitudinal axis of pipe 6 and displaced by a distance to one side or the other. Thus, in addition to determining the position of positional transmitter 76 in the translational direction, it is also necessary to perform similar measurements in a direction transverse to the translational direction to determine precisely where the longitudinal axis of pipe 6 lies below the grade.

With specific reference to FIG. 7, which is an end view of positional transmitter 76, it can be seen that the field lines of the dipole magnetic field generated by positional transmitter 76 extend radially outwardly therefrom. A single vertical antenna will produce a peak reading when positioned directly above the axis of pipe 6 at the front and rear locate points thereof. The precise position of the peak generated directly above pipe 6 may be difficult to accurately ascertain, thus potentially resulting in inaccurate positional determinations that may be a foot or more away from the actual location of positional transmitter 76. The difficulty of determining the precise location of positional transmitter 76 based upon peak readings both parallel with and perpendicular to the longitudinal axis of pipe 6 can thus result in compounded positional errors of several feet or more.

Figure 5:
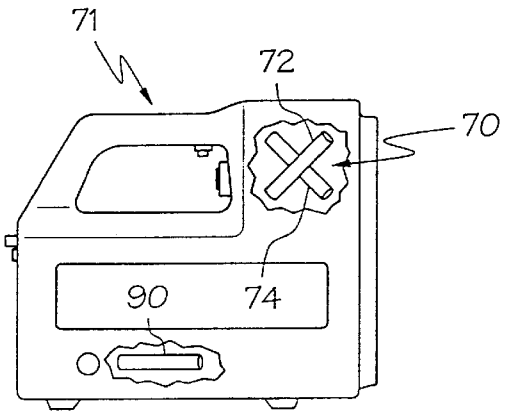
FIG. 5 is a side elevational view of the receiver, partially cut away, showing the first and second antennas.

It has been found, however, that by configuring positional receiver 70 with first and second antennas 72 and 74 perpendicular to one another and each being oriented 45° from the horizontal direction, the precise location of positional transmitter 76 can be determined more accurately and more quickly than with single and dual antenna systems employing antennas that are oriented in the vertical and/or horizontal directions. Such a preferred configuration is indicated generally in FIG. 5. Assuming that first and second antennas 72 and 74 are balanced, first and second antennas 72 and 74 will register signals that are equal with one another whenever positional receiver 70 is disposed at either of the null points generated by the single horizontal antenna, i.e., above the front and rear locate points, as well as when positioned directly above positional transmitter 76. First and second antennas 72 and 74 register such equal signals inasmuch as the field lines bisect the angle between first and second antennas 72 and 74 at those points.

It can be seen, therefore, that when first and second antennas 72 and 74 are configured as set forth above, i.e., perpendicular to one another and both being oriented 450 from the horizontal direction, the peak points and null points as determined before by using the single vertical or horizontal antennas can now be determined merely by comparing the relative signal strengths generated by first and second antennas 72 and 74 in response to the dipole magnetic field generated by positional transmitter 76. Specifically, by moving positional receiver 70 above grade in a direction parallel with the longitudinal axis of pipe 6, one can determine the aforementioned null and/or peak points merely by observing when positional receiver 70 indicates that the outputs of first and second antennas 72 and 74 are equal. Again, such congruity in antenna signal will occur when the field lines of the dipole magnetic field generated by positional transmitter 76 are either parallel with the horizontal direction or perpendicular thereto. This phase of the process is best illustrated in FIG. 6.

After the front and rear locate points are determined, the workman holds positional receiver 70 over one of the locate points, rotates positional receiver 70 ninety degrees as measured about a vertical axis, and moves positional receiver 70 in a direction perpendicular with the longitudinal axis of pipe 6, as is indicated generally in FIG. 7. When first and second antennas 72 and 74 register equal signal strengths, a cone 92 is placed immediately below positional receiver 70. Positional receiver 70 is then moved to the other locate point, rotated ninety degrees, and moved in a direction perpendicular with the longitudinal axis of pipe 6 as set forth hereinbefore, with another cone 92 likewise being dropped at the point that first and second antenna 72 and 74 indicate equal signals. Positional transmitter 76 will be directly below a point midway between cones 92. An imaginary line drawn through both cones 92 indicates the direction of positional transmitter. 76 and, in turn, the direction of drillhead 8 that carries positional transmitter 76.

The foregoing process is based upon the assumption that first and second antennas 72 and 74 are balanced, i.e., that first and second antennas 72 and 74 generate the same signal strength when experiencing the same magnetic field. If first and second antennas 72 and 74 are unbalanced, the aforementioned method for location positional transmitter 76 will be inaccurate. It is thus preferred that positional receiver 70 additionally include a calibration device of the type known and understood in the art for balancing first antenna 72 with second antenna 74.

Positional transmitter 76 preferably is of the type having a set of wires 78 extending therefrom of sufficient length to supply power thereto from a remote power supply. It is understood, however, that positional transmitter 76 may include a set of batteries to provide power thereto instead of wires 78 without departing from the spirit of the present invention.

The dipole magnetic field generated by positional transmitter 76 preferably differs from the source or source-like magnetic field emanating from a utility cable. Positional transmitter 76 also preferably transmits a radio frequency signal that indicates the pitch of positional transmitter 76 with respect to the horizontal direction. Such pitch information is determined and transmitted using known structures. Similarly, the depth of positional transmitter 76 below grade can be determined using known methods when positional receiver 70 is oriented directly above positional transmitter 76.

Specifically, the magnetic field strength ($B_1$) is measured by first and second antennas 72 and 74 at a first position that is located a distance ($d_1$) above positional transmitter 76. The first position is preferred to be directly at the grade. Similarly, the magnetic field strength ($B_2$) is measured from a second position that is vertically displaced from the first position and located a distance ($d_2$) above positional transmitter 76. If the distance between the first and second positions is known, the depth of positional transmitter 76 below the grade ($d_1$) may be calculated by simultaneously solving the following equations:

$$B_1=k/d_1^3$$

$$B_2=k/d_2^3$$

$$d=d_2-d_1$$

In this regard, it is understood that the strength of a magnetic field varies inversely with the cube of the distance from the transmitter to the receiver multiplied by a proportionality constant (k) that varies with the soil characteristics, attenuation of the signal by drillhead 8, as well as other factors.

Inasmuch as the first position ($d_1$) is at the grade, and the second position ($d_2$) is at a position vertically displaced above the grade, the distance (d) is easily determinable. To facilitate the determination of distance (d), unit 71 also includes an ultrasonic range finder 90 disposed on a lower face thereof that quickly determines the distance that unit 71 is held above the grade. The depth ($d_1$) of positional transmitter 76 below the grade can thus be readily determined by software resident in unit 71 that analyses the two magnetic field strength measurements $B_1$ and $B_2$ and the distance generated by ultrasonic range finder 93.

Prior to performing the aforementioned analyses, i.e., determining the position, direction, and depth of positional transmitter 76, pipe 6 and drillhead 8 must be at least nominally advanced into the subterranean location by underground boring machine 4. In this regard, it is desired that drillhead 8 be pointed toward the desired terminus of pipe 6 and that it be at the desired depth prior to fully activating control system 2 and making it a closed loop control operation.

Figure 10:
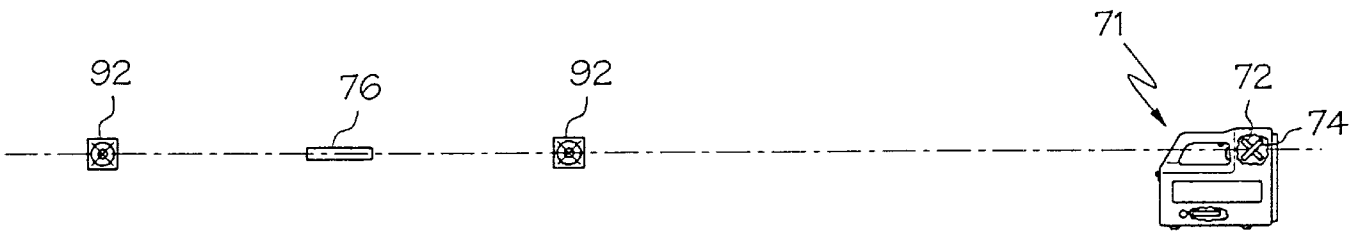
FIG. 10 is a top plan view of the receiver positioned in line with the direction of the drillhead.

Once the desired direction and depth of drillhead 8 have been achieved using the foregoing method and analysis, unit 71 is placed on its side on the ground above grade at the desired terminus of pipe 6 such that first and second antennas 72 and 74 are parallel with the ground and such that an imaginary line extending through the cones that indicate the direction of drillhead 8 bisects the angle between first and second antennas 72 and 74 (FIG. 10). In such position, the face of unit 71 where ultrasonic range finder 93 is disposed is parallel with the longitudinal axis of pipe 6. In accordance with the objectives of the present invention, unit 71 need not be positioned below grade in order to work properly. Control system 2 is then activated and underground boring machine 2 is started.

When control system 2 is activated with positional transmitter 76 pointed directly at the intersection of first and second antennas 72 and 74 (FIG. 10), first and second antennas 72 and 74 register equal field strength inasmuch as the components-of the dipole magnetic field generated by positional transmitter 76 that are parallel with first and second drive antennas 72 and 74 are equal. Any departure of the direction of drillhead 8 and positional transmitter 76 from a course directly toward unit 71 thus results in one of first and second antennas 72 and 74 registering a greater signal strength than the other. This imbalance in signal strength is conveyed to positional processor 80 mounted within unit 71.

Positional processor 80 includes known processing structures and software resident thereon that can calculate the direction and magnitude of the deviation of drillhead 8 from the desired direct course toward unit 71 by analyzing the unequal signals generated by first and second antennas 72 and 74. Position processor 80 can also calculate a correction course that will compensate for the deviation and will return drillhead 8 to the desired course. As is understood in the relevant art, the dipole magnetic field generated by positional transmitter 76 has a unique character usable by positional processor 80 to determine the nature and extent of the deviation of drillhead 8 from the desired course. Moreover, the generally dipole nature of the magnetic field generated by positional transmitter 76 allows positional processor 80 to determine if drillhead 8 is on a course parallel with pipe 6 but is displaced a given distance therefrom.

Positional processor 80 thus also produces a correction signal that will cause an adjustment apparatus 88 to compensate for the deviation. In the present invention, adjustment apparatus 88 is control motors 64, drive rods 58, and actuation drives 20. It is understood, however, that adjustment apparatus 88 may include different control structures without departing from the spirit of the present invention.

It is further understood that the correction signal produced by positional processor 80 may be of either an analog or a digital format depending upon the properties of positional processor 80. Likewise, the correction signal may be tailored to the particular bending characteristics of pipe 6, the desired final flow characteristics of pipe 6 with regard to the deviation, as well as other relevant factors.

The correction signal is transferred to control transmitter 82 which converts the correction signal into a radio frequency signal that can be detected by control receiver 84. Control transmitter 82 additionally transmits the pitch data that is received from positional transmitter 76. Control transmitter 82 is a radio frequency signal generator of the type known and understood in the art and may additionally include digital to analog signal convertors as needed to convert the correction signal into a format usable by control transmitter 82.

Control receiver 84 is a radio frequency receiver of the type known and understood in the relevant art and is a component of a remote receiver 92 that is disposed on sled 11 of underground boring, machine 4. Remote receiver 92 may be any of a wide variety of receivers known and understood in the relevant art and may, for instance, be the Remote Display sold under the name DIGITRAK™ by Digital Control Incorporated of Renton, Wash., U.S.A. Control receiver 84 receives the correction signal from control transmitter 82 and transfers the correction signal to control processor 86. Control processor 86 is any of a variety of known devices that can convert an electrical signal such as the control signal into a correction command that is used to control the function of control motors 64.

The correction signal received by control receiver 84 is thus transferred to control processor 86 for conversion into a correction command. The correction command is in the nature of a voltage or other command that causes the rotation in either direction of one or both of control motors 64 by a measured amount. The motion of control motors 64 is operatively transferred through flexible couplings 66 and drive rods 58 to expand or retract one or both actuation drives 20, thus causing drillhead 8 to selectively move in the horizontal direction with respect to pipe 6.

Control receiver 84 also receives a radio frequency signal from control transmitter 82 regarding the pitch of positional transmitter 76 and drillhead 8 with respect to the horizontal. Inasmuch as drillhead 8 initially was at the desired depth when control system 2 was activated, control processor 76 must merely maintain the pitch of positional transmitter 76 in the horizontal direction. Any deviation in pitch from the horizontal is corrected by expanding or retracting actuation drives 20 to point drillhead 8 in the downward or upward vertical directions, respectively, with respect to pipe 6. The correction signal thus includes any correction that is needed to maintain drillhead 8 at the desired depth below grade. Inasmuch as errors in depth can progressively propagate to produce an error of unacceptable magnitude, it is preferred that an integral controller or other such device be incorporated into control processor 86 to ensure that minor deviations in the pitch of positional transmitter 76 are corrected.

Control system 2 thus senses directional signals and pitch data generated by positional transmitter 76 and performs a series of operations to provide a compensatory directional command to drillhead 8 in response to a detected deviation by drillhead 8 from the desired course of travel. Specifically, the dipole magnetic field and pitch signals generated by positional transmitter 76 are received by first and second antennas 72 and 74 and are converted by positional processor 80 into a correction signal. The correction signal is transmitted by control transmitter 82 and is received by control receiver 84 located on sled 11. Control receiver 84 transfers the correction signal to control processor 86 which converts the correction signal into a correction command that is delivered to control motors 64 to expand or retract actuation drives 20 to alter the direction of drillhead 8 with respect to pipe 6.

Once drillhead 8 and pipe 6 have reached a position directly below unit 71, unit 71 can be readily moved to a different above ground location to which control system 2 can direct the driving of pipe 6 and drillhead 8. In this regard, control system 2 can be employed to direct pipe 6 around obstructions without requiring that unit 71 be disposed below grade at any point. Moreover, control system 2 of the present invention requires far less input and attention by a workman than a manual configuration, thus reducing the labor cost in running a subterranean pipe. Control system 2 thus achieves substantial benefits neither disclosed nor contemplated by the prior art.

Accordingly, the improved auger drill directional control systems apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner-in which the auger drill directional control system is constructed and used, the characteristics of the construction, and the advantageous new and useful results obtained; the new and useful structures, devices, elements, arrangements, parts, and combinations are set forth in the appended claims.

I claim:

1. In an underground boring machine for driving a pipe through a subterranean location, the underground boring machine being of the type including a sled, a drillhead mounted on the pipe, a positional transmitter disposed in the drillhead, the positional transmitter transmitting a positional signal, and an adjustment apparatus operatively connected between the sled and the drillhead, said adjustment apparatus comprising:

a pair of actuation drives and a pair of control motors, each of said actuation drives being operationally mounted between the pipe and the drillhead and operationally connected with said control motors;

a pair of drive rods, each of which is operationally mounted between a respective one of the actuation drives and a respective one of said control motors; a pair of flexible couplings, each of said flexible couplings extending between and connected to a respective one of the drive rods and control motors; and a knuckle operationally mounted between the pipe and the drillhead and spaced substantially evenly about the circumference of the pipe between the actuation drives, with said knuckle disposed at substantially a lowermost point along the circumference of the pipe.

2. The adjustment apparatus defined in claim 1 in which the actuation drives are disposed on the circumference of the pipe and spaced from said knuckle by an angle in approximately the range of from 100° to 140° , said actuation drives being spaced apart from one another along the circumference of the pipe by an angle in approximately the range of from 80° to 160°.

3. The adjustment apparatus defined in claim 1 wherein the knuckle includes a socket and a spherical ball movably mounted within said socket.

4. In an underground boring machine for driving a pipe through a subterranean location, the underground boring machine being of the type including a sled, a drillhead movably mounted with respect to the pipe, a positional transmitter disposed in the drillhead, the positional transmitter transmitting a positional signal, and an adjustment apparatus operatively connected between the sled and the drillhead, said adjustment apparatus comprising:

a pair of actuation drives and a pair of control motors, each of said actuation drives being operationally mounted between the pipe and the drillhead and operationally connected with a respective one of said control motors; and each of said actuation drives includes a first member mounted on the drilihead and a second member mounted on the pipe, said first member being threadably engaged with the second member for causing movement of the drillhead with respect to the pipe in response to the positional signal.

5. The adjustment apparatus defined in claim 4 wherein each of the second members includes a hollow collar and a threaded sleeve extending therethrough, said sleeve being formed with an internally threaded bore; and in which each of the first member includes a threaded stud which is threadably engaged within the internally threaded bore of the second member to provide for movement between the first and second members.

6. The adjustment apparatus defined in claim 5 wherein a drive rod operationally connects each of the control motors to a respective one of the threaded sleeves of the second members for rotating said threaded sleeves in response to positional signal from the positional transmitter.

7. The adjustment apparatus defined in claim 6 wherein each of the threaded sleeves terminates in a drive head having at least one flat surface; and in which each of the drive rods terminates in a drive socket which slidably receives the drive head therein to provide a drive connection therebetween.

8. The adjustment apparatus defined in claim 5 wherein each of the hollow collars of the second members includes a pair of protrusions; in which a pair of plates are secured to the pipe; and in which said protrusions are pivotably attached to said plates to pivotably mount the second member on the pipe.

9. The adjustment apparatus defined in claim 4 wherein the first member includes a block formed with a substantially cylindrical cavity containing a threaded stud; in which a pivot plate is secured to the drillhead; and in which said block is pivotably mounted on the pivot plate.

10. In an underground boring machine for driving a pipe through a subterranean location, the underground boring machine being of the type including a sled, a drillhead mounted on the pipe, a positional transmitter disposed in the drillhead, the positional transmitter transmitting a positional signal, and an adjustment apparatus operatively connected between the sled and the drillhead, said adjustment apparatus comprising:

a pair of actuation drives and a pair of control motors, each of said actuation drives being operationally mounted between the pipe and the drillhead and operationally connected with a respective one of said control motors;

a knuckle operationally mounted between the pipe and the drillhead and located on the circumference of the pipe between the pair of actuation drives, said knuckle includes a socket mounted on one of the pipe and drillhead and a spherical ball mounted on the other of said pipe and drillhead, said ball being movably mounted within said socket; and each of said actuation drives includes a first member pivotably mounted on the drillhead and a second member pivotably mounted on the pipe, and a threaded connection movably adjustable connecting together said first and second members for moving said drillhead with respect to said pipe.

* * * * *